United States Patent [19]

Korhonen

[11] Patent Number: 4,602,531

[45] Date of Patent: Jul. 29, 1986

[54] PROCESS AND APPARATUS FOR SHARPENING OF KNIVES

[76] Inventor: Kaarlo J. Korhonen, Säterivägen 18, S-161 70 Bromma, Sweden

[21] Appl. No.: 630,112

[22] Filed: Jul. 12, 1984

[30] Foreign Application Priority Data

Feb. 20, 1984 [SE] Sweden ..... 8400731

[51] Int. Cl.[4] ..... B24B 3/54

[52] U.S. Cl. ..... 76/82; 51/3; 51/159; 51/285; 51/59 R

[58] Field of Search ..... 51/149, 151, 152, 59 R, 51/153, 285, 156, 157, 158, 159, 204, 206, 209 R, 109, 3; 76/82

[56] References Cited

U.S. PATENT DOCUMENTS

| | | | |
|---|---|---|---|
| 2,404,192 | 7/1946 | Ries et al. | 51/204 |
| 2,435,671 | 2/1948 | Clark et al. | 51/158 |
| 3,299,579 | 1/1967 | Jacobson | 51/206 R |
| 3,874,120 | 4/1975 | Dalton et al. | 51/153 |
| 3,883,995 | 5/1975 | Ohashi | 51/159 |

*Primary Examiner*—Roscoe V. Parker

*Attorney, Agent, or Firm*—Burns, Doane, Swecker & Mathis

[57] ABSTRACT

A process and an apparatus for sharpening of knives. The apparatus comprises a holder for the knife, a sharpening element, structure for displacing the sharpening element along the edge of the knife with a predetermined angle between the plane of the knife blade and the finishing surface of the sharpening element. Structure is arranged to periodically shift the engagement between the sharpening element and the knife between the two sides of the edge. Structure is arranged for relatively displacing the sharpening element transverse to the longitudinal direction of the edge, and the sharpening element is arranged with successively increasing sharpening fineness in said transverse displacement direction. The highest sharpening fineness of the sharpening element is formed by a sharpening steel section. The transverse displacement structure is arranged, during a sharpening operation, to displace the sharpening element related to the knife holder to successively bring the knife edge to engage the sections with higher sharpening fineness of the sharpening element.

7 Claims, 11 Drawing Figures

PROCESS AND APPARATUS FOR SHARPENING OF KNIVES

TECHNICAL FIELD

The invention refers to a process for sharpening a knife by means of a sharpening means, comprising relatively displacing the sharpening means along the knife edge with predetermined angle between the plane of the knife blade and the finishing surface of the sharpening means. The invention also refers to an apparatus for sharpening a knife, comprising a holder for the knife, a sharpening means, and means for controlled displacement of the sharpening means along the edge of the knife with a predetermined angle between the plane of the knife blade and the finishing surface of the sharpening means.

BACKGROUND

Especially in the field of industrial cutting up of meat, it is necessary that the butchers at all times have access to sharp knives. A knife edge is ground such that the edge angle provides a correct cutting edge. The curvature of the edge line is corrected, and the edge line will lie in a plane which usually is the symmetry plane of the knife. Such a finishing operation can be performed in several steps, that is first a coarse grinding and then a fine grinding. Before and during the meat cutting work, the butcher must further finish the knife edge by means of a so called finishing steel, that is a substantially smooth steel rod, which generally is moved along the knife edge in order to provide the edge with a curvature as sharp and smooth as possible.

This "steeling" is important, especially in connection with cutting away meat from bone, as a steeled knife edge is a prerequisite in order to avoid damages to the knife edge or avoiding the knife edge cutting into bone when the knife is moved adjacent the bone. The steeling operation develops a knife edge that becomes smooth and straight so that the knife edge, in microscale, does not develop a saw tooth configuration in the plane of the knife blade or any wave shape along its length across said plane of the knife blade.

Correct use of a steel (sharpening steel) requires substantial practice, and many butchers cannot learn the technique, because the correct use is that the sharpening steel is held with a correct angle to the knife edge plane and an erroneous angle means that the steeling operation will produce a blunter knife or means that the edge is not effected by the steeling. The sharpness of the knife is decisive for the working capacity of the butcher and the cutting up yield, because a blunter knife requires exertion of more power and, therefore, reasonably reduces the working capacity of the butcher, and also causes a risk of a lower yield of meat from the cutting up operation.

An apparatus for the sharpening of a knife is previously known and comprises a stand with a holder for the knife, a whetstone and a rod which is fixedly connected to the whetstone and pivotably mounted in the stand so that the whetstone is arranged with a predetermined, substantially constant angle to the plane of the knife blade. By displacing the whetstone along the knife edge, it is possible to finish one side of the knife edge in the desired manner and thereafter the knife is detached from the holder and turned for finishing of the other edge side. However, there is no possibility of periodically shifting the edge treatment position of the whetstone from one edge side to the other during a knife sharpening operation, and therefore the known apparatus does not offer any useful sharpening of the knife since after treatment of the knife in the known apparatus, the knife must be further treated for removal of burr formed on the knife edge, and the knife edge must be steeled in order to be brought to required sharpness for effective use.

An object of the invention is to provide a knife sharpening process and an apparatus which offers fully acceptable sharpening including steeling of a knife without reliance on the operator's ability intuitively to feel whether or not the treatment leads to the decided sharpness for the knife edge.

CHARACTERIZATION OF THE INVENTION

A process for sharpening of a knife by a sharpening means is based on the steps of relatively displacing the sharpening means along the knife edge with a predetermined angle between the plane of the knife blade and the finishing surface of the sharpening means, and is characterized by the steps of displacing the sharpening means across the longitudinal direction of the knife edge, using a sharpening means which in its displacement direction across the longitudinal direction of the edge is arranged with increasing sharpening fineness and includes a steeling portion, and, during the sharpening operation, relatively displacing the sharpening means across the longitudinal direction of the knife edge so that the knife edge successively is brought to engage the areas of the sharpening means having higher sharpening fineness. Preferably, the method comprises the step of periodically shifting the treatment position of the sharpening means on the knife edge between the sides of the knife edge. In the sharpening process it is preferred to perform said shifting in connection to the end of stroke of the displacement of the sharpening means in the longitudinal direction of the knife edge.

An apparatus for sharpening of a knife comprises a holder for the knife, a sharpening means, and means for controlled displacement of the sharpening means generally in the longitudinal direction of the edge with a predetermined angle between the plane of the knife blade and the finishing surface of the sharpening means and is characterized in that means are arranged for relatively displacing the sharpening means across the longitudinal direction of the edge, that the sharpening means is arranged with successively increasing sharpening fineness in its general direction of displacement across the longitudinal direction of the edge, the highest sharpening fineness of the sharpening means being formed by a sharpening steel, and that the displacement means is arranged, during a sharpening operation, to displace the sharpening means relative to the knife holder so that the knife edge successively is brought to engage areas of the sharpening means having higher sharpening fineness. Preferably, the apparatus also comprises means arranged to periodically shift the treatment position of the sharpening means on the knife from one side of the edge to the other during the knife sharpening operation.

In the following the invention will be closer described in the form of examples on embodiments, in connection to the appended drawings.

DRAWINGS

FIG. 1 schematically illustrates an elevation view of a first embodiment of an apparatus according to the invention.

FIG. 2 illustrates a view taken along line II—II in FIG. 1.

FIG. 3 schematically illustrates a second embodiment of an apparatus according to the invention.

FIG. 4 illustrates a section taken along line IV—IV in FIG. 3.

FIG. 5 schematically shows the sharpening grade for sharpening element in the apparatus according to the invention.

FIG. 6 schematically shows a section taken along line VI—VI in FIG. 4.

FIG. 7 schematically shows an elevational view of a third embodiment of the apparatus according to the invention.

DETAILED DESCRIPTION OF THE PREFERRED EMBODIMENTS

Figure 1:
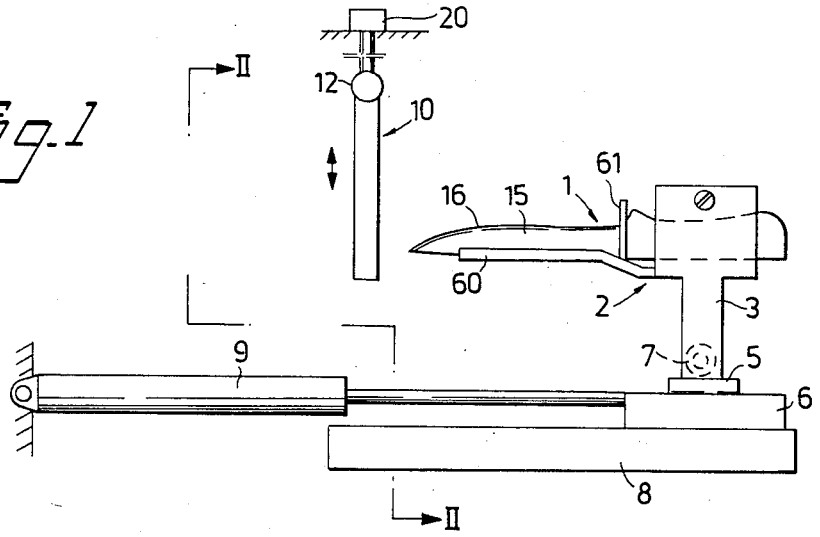

In FIG. 1 there is shown a holder 2 for a knife 1. The holder 2 comprises a shaft 3 which by means of a bearing 5 is pivotably connected to a sled 6. The holder 2 and the bearing 5 are arranged to permit the knife to be pivoted substantially in a plane normal to the longitudinal direction of the knife blade 15.

The sled 6 supports a cylinder 7, which is connected to the shaft or arm 3 for pivoting around the bearing 5. The sled 6 is displaceable along a track 8 in a direction, which is substantially parallel to the general longitudinal direction of the knife blade 15 and the knife edge 16. A cylinder 9 is connected between the stand of the machine and the sled 6, for displacement of the sled 6 along the track 8.

A sharpening means 10 comprising two parallel separate sharpening elements 11 is carried by the apparatus stand via a displacement means 20. The sharpening rods 11 lie substantially in a plane which is normal to the movement direction of sled 6, and the bearing 5 is midway between the axis of the sharpening rods 11.

Figure 2:
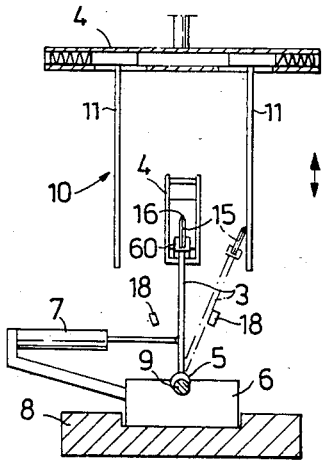
Figure 5:
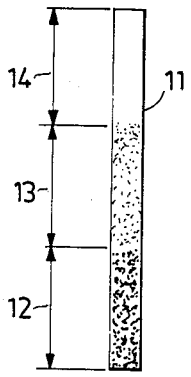
Figure 6:
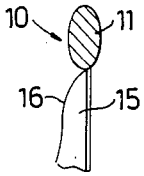
Figure 9:
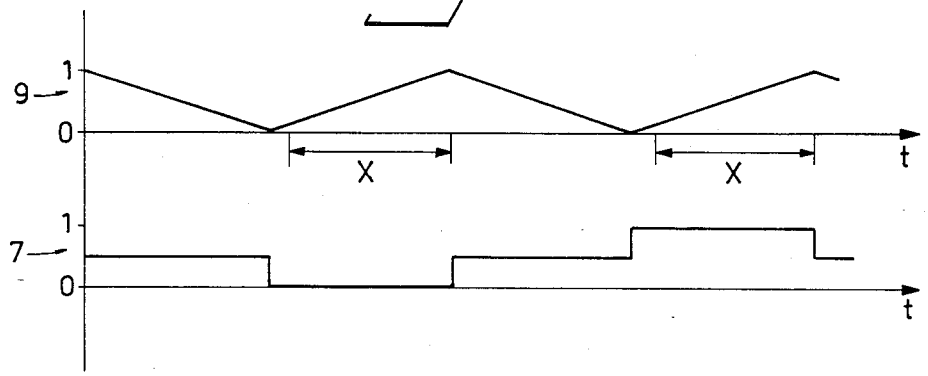
FIGS. 9, 10 and 11 illustrate the operation sequence for the apparatus according to FIGS. 1, 3 and 7, respectively.

A sharpening rod 11 can, as appears from FIG. 5, be straight and have successive sections 12,13,14 with increasing sharpening fineness along the length thereof, the section 14 with highest sharpening fineness consisting of sharpening steel, that is, a substantially smooth surface 14 of the steel or the like. In FIGS. 1 and 2, the section 14 is at the upper portion of rods 11. The apparatus according to FIGS. 1 and 2 operates in the way indicated in FIG. 9, wherein the references 0 and 1 indicate the contracted and expanded condition for the respective cylinder, and t refers to a time axis. One can assume that the sharpening means 10 is in such position that the knife edge 16 initially will run along the coarsest finishing section 12 of the rods 11, and that the holder 2 is arranged so that the knife blade 15 forms a predetermined angle of for example 22.5° with the longitudinal direction for the rods 11 when the knife blade 15 is in engagement therewith.

Starting from FIG. 1, it is appreciated that the cylinder 7 first is contracted so that the knife blade 15 freely passes between the rods 11 until the innermost portion of the knife blade 1 arrives at the plane defined by the rods 11.

Then, the cylinder 7 is activated so that the knife blade 15 is brought to engage either rod 11 with a predetermined force, which can be controlled by adjustment of the working pressure of cylinder 7. Thereafter the cylinder 9 is expanded for displacement of the sled 6, so that the knife edge 16 is finished by the rod section 12. Then, the cylinder 7 is driven in order to again put the knife 1 in a position between and separate from the rods 11 whereupon the cylinder 9 is contracted and the cylinder 7 is activated in order to pivot the knife edge 16 to engage the other rod 11 with a predetermined force. The cylinder 9 is expanded during finishing of the other side of the edge. The sequence is repeated a desired number of times, and the two sides of the knife edge and alternatingly finished during the intervals which are indicated with x in FIG. 9. The operation cycle is repeated a desired number of times, and during the operation, the sharpening means 10 is displaced downwardly by the displacement means 20 such that the knife edge successively is subjected to finer finishing and finally a steeling. A full operation can comprise that each side of the knife edge runs in engagement with a sharpening rod 11 ten times along section 12, ten times along section 13 and fifteen times along the steeling suction 14.

The length of stroke of cylinder 9 is adapted such that in one end position, the innermost portion of the knife blade 15 is located adjacent the rods 11, and such that the other end position is arranged to permit finishing of knives with a certain maximum knife blade length.

Figure 10:
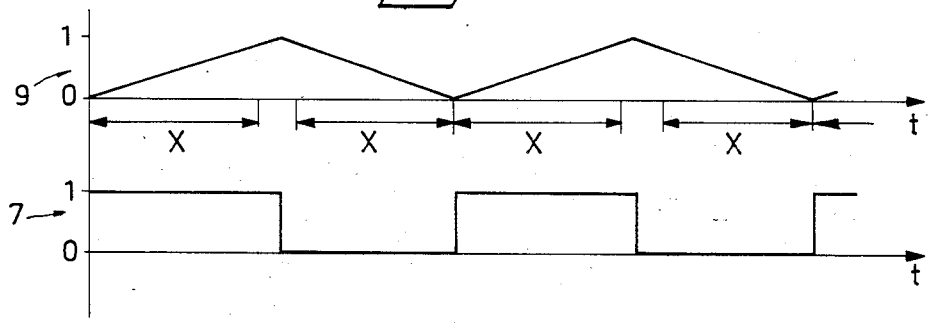

In FIGS. 3–6 there is shown a second embodiment on the inventive apparatus. In the apparatus according to FIGS. 3–6 one can again see the main components in the embodiment according to FIG. 1, the main differences comprising that the sharpening means 10 consists of a single centrally arranged sharpening rod 11, which is supported for limited parallel displacement from its normal position, against the force of a spring 40. Moreover, the knife holder 1 is journalled for pivoting motion in a bearing 5 the axis of which extends generally in the plane of the knife blade 15 between the back and edge 16 of the knife blade. The holder 1 is provided with an extra arm 17 which is actuated by the cylinder 7. With reference to FIG. 10 it is appreciated that the operation sequence of cylinders 7 and 9 offers a finishing of one side of the knife edge 16 during two consecutive strokes of cylinder 9. It is appreciated that the holder 1 brings the tip of the knife blade to engage either side of the generally oval sharpening rod 11, the major axis of which is oriented in the work direction of the cylinder 9.

The engagement force between the knife edge 16 and the rod 11 is determined by the spring 40 and possibly by thickness of the rod 11, but the spring 40 is preferably arranged to provide a constant reaction force against the rod 11 independently of the displacement direction thereof related to the normal position of rod 11. The spring 40 can of course be adjustable and, alternatively, a spring 40 can be arranged on either side of rod 11 in the rod holder 12, which is supported by the means 20. From FIG. 10 one can see that finishing of the knife edge occurs during all the working strokes of cylinder 9.

Figure 8:
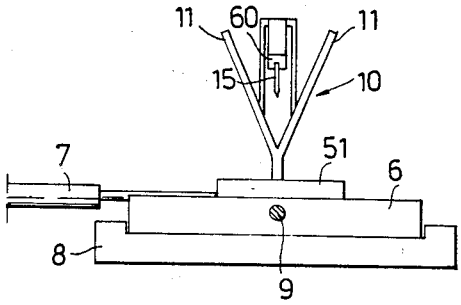
FIG. 8 shows a view taken along line VIII—VIII in FIG. 7.
Figure 11:
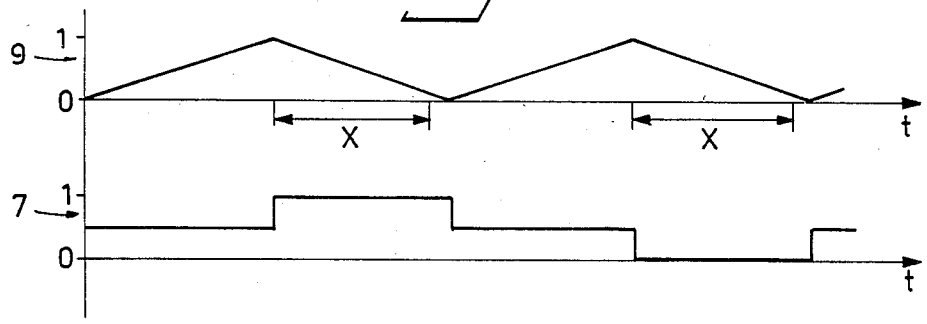

With reference to FIG. 8 there is shown an example on an apparatus comprising a sled 6, which is guided along a track 8 and driven by a cylinder 9. On the sled 6 there is a cross-track 50 with a sled 51 that carries a sharpening means 10 in the form of two sharpening rods 11, which are arranged with a fixed angle of for example 22.5° to the fixed plane of knife blade 15, said fixed plane constituting a bisectrice to rods 11. The cylinder 7 is supported by the sled 6 and actuates sled 51 in order to alternatingly bring either rod 11 to engage the edge 16. The knife holder 1 is fixed in the work plane of cyliners 7 and 9, and displacement means 20 drives the holder 1 in order to successively bring the knife edge 16 to engagement with the sections of rods 11 having higher treatment fineness. From FIG. 11 it appears that the operation of the apparatus according to FIGS. 7 and 8 substantially is analogous to that according to FIG. 9, that is for the apparatus according to FIGS. 1 and 2, the difference substantially being that the knife holder 1 is subjected to slow displacement movement only, without having to be pivoted or turned relative to the apparatus stand.

With reference to that part of the operation sequence wherein the rounded tip of the knife edge 11 leaves or moves up on the sharpening rod 10 in question, the sharpening rods should have a cross-section, whose active circumferential portion, which faces the knife holder, forms an angle to the longitudinal direction of the knife blade 15, that is as small as possible. The circumference contour of said portion, could constitute generally a quarter of an ellipse the major axis of which is parallel to the movement direction of sled 6.

Figure 3:
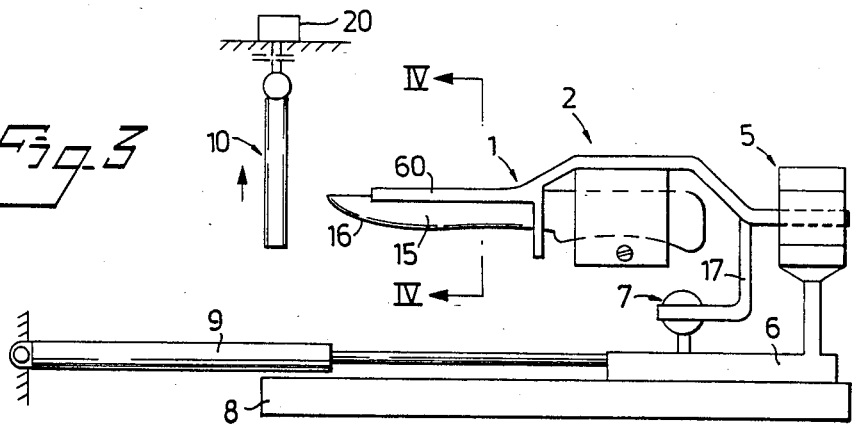
Figure 7:
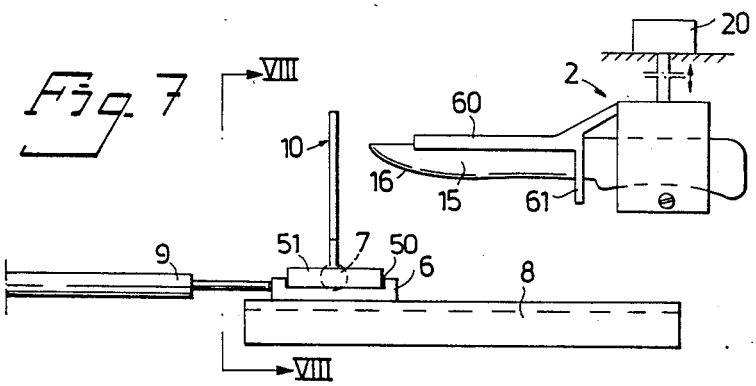

With reference to FIGS. 1, 3 and 7 one can see that the holder 1 comprises a guide rail 60 for the back of the knife blade 15 in order to prevent the knife blade from flexing during engagement with the sharpening rod 11 in question. Moreover, the holder can comprise a slotted plate 61, the slot of which forms a guide for the knife blade such that the plane of the blade 15 is correctly located in relation to holder 1. Moreover, the plate 61 serves to form an abutment surface for the grip of the knife 1 so that the knife blade longitudinally is located in correct position in the holder. The correct position being stationary with respect to movements in the longitudinal direction of the knife's edge.

The holder 1 is arranged to hold the knife blade 15 in such a position that the edge 16 sweeps the smallest possible length portion of the sharpening rod 11 during each working stroke of cylinder 9. The holder 1 can be equipped with clamping means which, when actuated, automatically clamps the knife via the grip thereof in the position defined by the rail 60 and the guide plate 61.

Three different embodiments of the invention have been illustrated, but it should appreciated that these embodiments only constitute examples on possible embodiments of the inventive apparatus. The movement of the knife in relation to the sharpening means is relative and that numerous structural variations are clear to those skilled in the art within the scope of the appended claims. The embodiment according to FIGS. 7 and 8 has the advantage that the knife is not subjected to any turning or pivoting motion around its longitudinal axis and furthermore is not subjected to any reciprocating movement along its longitudinal axis.

Figure 4:
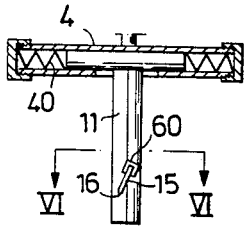

The embodiment according to FIGS. 3 and 4 has the advantage of offering cooperation between the knife edge and the sharpening means during both forward and rearward movement of the knife, but has the disadvantage that the respective side of the knife edge is subjected to two treatment steps before the other edge side is brought to engage the sharpening means.

In all the embodiments the cylinder 7 can be adjusted in order to generate the desired engagement force between the knife edge and the respective sharpening rod 11. The displacement means 20 can be an hydraulic cylinder which offers the desired displacement speed in view of the desired number of reciprocation movements, especially grinding movements for the sled 6.

It should of course also be clear that one instead of the indicated cylinders 7, 9 and 20, which can be hydraulic or pneumatic cylinders, can use any other known drive means, for example linear electric motors, screw nut drives or the like. The control means for providing the suitable work sequence for the cylinders of the apparatus can be arranged in knowns ways and with guidance of FIGS. 9–11, and it should also be clear that the means 20 to advantage can be arranged during a sharpening operation to slowly displace the sharpening means 10 for said purpose, and after a finishing operation return the sharpening means 10 to starting position, and then the return movement can to advantage be arranged faster than the feed movement.

I claim:

1. A process for sharpening of a knife by means of a sharpening means comprising relatively displacing the sharpening means along the edge of the knife with a predetermined angle between the plane of the knife blade and the finishing surface of the sharpening means, characterized by displacing the sharpening means across the longitudinal direction of the knife edge, using a sharpening means which in the displacement direction thereof across the longitudinal direction of the knife edge is arranged with increasing sharpening fineness and comprises a steeling section, and, during the sharpening operation, relatively displacing the sharpening means across the longitudinal direction of the knife edge in order to successively bring the knife edge to engagement with sections of the sharpening means having higher sharpening fineness.

2. A process according to claim 1 comprising periodically shifting the engagement between the knife edge and the sharpening means between the two sides of the knife edge.

3. An apparatus for sharpening of a knife, comprising a holder (2) for the knife (1), a sharpening means (10) and means (6,8,9) for displacing the sharpening means (10) along the edge (16) of the knife with a predetermined angle between the plane of the knife blade (15) and the finishing surface of the sharpening means (10), characterized by means (3,5,7;5,17,7,40;50,51) for periodically shifting the engagement between the knife blade and the sharpening means (10) between the two sides of the knife edge, means (20) for relatively displacing the sharpening means transverse to the longitudinal direction of the edge (16), said sharpening means (10) being arranged with successively increasing sharpening fineness (12–14) in the displacement direction thereof transverse to the longitudinal direction of the edge (16), the highest sharpening fineness of the sharpening means (10) being formed by sharpening steel, and the transversed displacement means (20) being arranged, during a sharpening operation, to relatively displace the sharpening means to successively bring the knife edge (16) to engage sections (12,13,14) of the sharpening means having higher sharpening fineness.

4. An apparatus according to claim 3 wherein, the sharpening means has a form of two parallel separate sharpening rods (11) which are arranged displaceable in the longitudinal direction thereof, that the shifting means comprises a pivotable arm (3) which carries the knife holder (2) and is journalled in a pivot bearing (5) in a position such that the plane of the knife blade (15) takes the predetermined angle to the longitudinal direction of either rod (11) when the knife engages the rod in question.

5. An apparatus according to claim 3, wherein the sharpening means is in the form of two mutually connected sharpening rods (11), which form a V-configuration and are supported on a first sled which is arranged displaceable across the longitudinal direction of the knife blade on a second sled (6), which is arranged displaceable in the longitudinal direction of the knife blade by the means (9) for longitudinal displacement, a cross-drive means (7) being connected between the sleds (6,51), the transverse displacement means being arranged to cause a relative movement between the second sled and the knife holder (2).

6. An apparatus according to claim 5, wherein the knife holder (2) is stationary.

7. An apparatus according to claim 3, wherein the sharpening means comprises a sharpening rod with two sharpening surfaces which face away from each other, that the movement direction of the knife blade (15) extends through the sharpening rod, that the knife holder (2) is journalled for rotation around an axis which is parallel to the longitudinal direction of the knife blade and which lies between the back of the knife blade and the major portion of the knife edge, and that the knife holder is rotatable round the journal axis thereof to predetermined angular positions relative to the longitudinal direction of the sharpening rod, and that the sharpening rod is arranged parallel displaceable transverse to the direction of the longitudinal movement of the knife, against the action of bias means (40).

* * * * *